US010403964B2

(12) United States Patent
Yoo et al.

(10) Patent No.: US 10,403,964 B2
(45) Date of Patent: Sep. 3, 2019

(54) TERMINAL INCLUDING MULTIBAND ANTENNA AS CONDUCTIVE BORDER

(71) Applicant: Pantech Inc., Seoul (KR)

(72) Inventors: Kyoung Sang Yoo, Seoul (KR); Myung Gu Kang, Seoul (KR)

(73) Assignee: Pantech Inc., Seoul (KR)

( * ) Notice: Subject to any disclaimer, the term of this patent is extended or adjusted under 35 U.S.C. 154(b) by 618 days.

(21) Appl. No.: 14/222,090

(22) Filed: Mar. 21, 2014

(65) Prior Publication Data

US 2014/0292590 A1 Oct. 2, 2014

(30) Foreign Application Priority Data

Mar. 29, 2013 (KR) ..... 10-2013-0034406

(51) Int. Cl.

| | |
|---|---|
| ***H01Q 1/24*** | (2006.01) |
| ***H01Q 7/00*** | (2006.01) |
| ***H01Q 9/42*** | (2006.01) |
| ***H01Q 21/28*** | (2006.01) |
| ***H01Q 5/371*** | (2015.01) |
| ***H01Q 5/378*** | (2015.01) |

(52) U.S. Cl.

CPC ..... *H01Q 1/243* (2013.01); *H01Q 5/371* (2015.01); *H01Q 5/378* (2015.01); *H01Q 7/00* (2013.01); *H01Q 9/42* (2013.01); *H01Q 21/28* (2013.01); *Y10T 29/49016* (2015.01)

(58) Field of Classification Search

CPC .. Y10T 29/49016; H01Q 5/371; H01Q 5/378; H01Q 1/243; H01Q 9/42; H01Q 21/28; H01Q 7/00

USPC ..... 343/702, 745, 700 MS

See application file for complete search history.

(56) References Cited

U.S. PATENT DOCUMENTS

| | | | | |
|---|---|---|---|---|
| 8,610,629 | B2 * | 12/2013 | Pascolini | H01Q 1/243 343/702 |
| 9,899,728 | B2 * | 2/2018 | Wang | H01Q 1/243 |
| 2004/0257283 | A1 | 12/2004 | Asano et al. | |

(Continued)

FOREIGN PATENT DOCUMENTS

| | | |
|---|---|---|
| JP | 2003-051712 | 2/2003 |
| JP | 2012-186811 | 9/2012 |

(Continued)

OTHER PUBLICATIONS

"Antenna Theory: A Review," Constantine A. Balanis, Proceedings of the IEEE, vol. 80, No. 1, section III.B, Jan. 1992.*

(Continued)

*Primary Examiner* — Graham P Smith
*Assistant Examiner* — Jae K Kim
(74) *Attorney, Agent, or Firm* — H.C. Park & Associates, PLC

(57) ABSTRACT

A conductive border surrounds a terminal along a direction. A mobile terminal includes a wireless transmission/reception circuit to output a signal for a wireless communication of the mobile terminal; a conductive border that forms side surfaces of the mobile terminal; a ground element electrically connected to the conductive border; a first antenna element electrically connected to the conductive border and the wireless transmission/reception circuit; and a second antenna element electrically connected to the conductive border and the ground element.

16 Claims, 22 Drawing Sheets

(56) References Cited

U.S. PATENT DOCUMENTS

2008/0316121 A1* 12/2008 Hobson ..... H01Q 1/243 343/702
2009/0256759 A1* 10/2009 Hill ..... H01Q 1/243 343/702
2009/0257207 A1* 10/2009 Wang ..... G06F 1/1626 361/752
2010/0053002 A1 3/2010 Wojack et al.
2010/0087235 A1* 4/2010 Chiang ..... H01Q 1/243 455/575.7
2011/0241949 A1* 10/2011 Nickel ..... H01Q 1/243 343/702
2012/0009983 A1* 1/2012 Mow ..... H01Q 1/243 455/575.7
2012/0218723 A1* 8/2012 Kwak ..... H01Q 1/243 361/748
2012/0229347 A1 9/2012 Jin et al.
2012/0262345 A1* 10/2012 Kim ..... H01Q 1/243 343/702
2014/0007983 A1* 1/2014 Prest ..... B22D 19/0081 148/403
2015/0171916 A1* 6/2015 Asrani ..... H04B 1/68 455/575.7
2016/0164169 A1* 6/2016 Krogerus ..... H01Q 21/28 343/702
2017/0033440 A1* 2/2017 Kim ..... H01Q 1/243
2017/0062912 A1* 3/2017 Shewan ..... H01Q 1/273
2017/0271765 A1* 9/2017 An ..... H01Q 25/30
2017/0279199 A1* 9/2017 An ..... H01Q 25/30
2017/0294706 A1* 10/2017 Koga ..... H01Q 1/24

FOREIGN PATENT DOCUMENTS

JP 2012-249281 12/2012
KR 10-2012-0117048 10/2012
WO WO 2008017844 A2 * 2/2008 ..... H01Q 1/273
WO 2012/147355 1/2012

OTHER PUBLICATIONS

European Search Report (EESR) for European Patent Application No. 14161640.9 dated Jul. 28, 2014.

* cited by examiner

FIG. 15

| | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| Frequency(MHz) | 824 | 870 | 915 | 960 | 1710 | 1740 | 1770 | 1800 | 1830 | 1860 | 1890 | 1920 | 1950 | 1980 | 2010 | 2040 | 2070 | 2100 | 2130 | 2170 |
| Efficiency(dB) | -8.53 | -7.14 | -8.21 | -12.73 | -6.03 | -5.59 | -4.93 | -4.60 | -4.39 | -4.39 | -4.65 | -5.42 | -5.85 | -5.67 | -5.18 | -5.69 | -6.22 | -6.14 | -5.46 | -4.62 |
| Efficiency(%) | 14.03 | 19.32 | 15.11 | 5.33 | 24.97 | 27.59 | 31.77 | 34.64 | 36.38 | 36.42 | 34.26 | 28.68 | 25.99 | 27.12 | 30.36 | 26.97 | 23.86 | 24.33 | 28.44 | 34.55 |

TERMINAL INCLUDING MULTIBAND ANTENNA AS CONDUCTIVE BORDER

CROSS-REFERENCE TO RELATED APPLICATIONS

This application claims priority from and the benefit under 35 U.S.C. § 119(a) of Korean Patent Application No. 10-2013-0034406, filed on Mar. 29, 2013, which is hereby incorporated by reference in its entirety for all purposes as if fully set forth herein.

BACKGROUND

Field

Exemplary embodiments of the present invention relate to a terminal including a multiband antenna as a conductive border.

Discussion of the Background

As various electronic devices have been developed and used in daily life, new terminals, which not only have good qualities and functions but also have appealing designs, have been demanded. In particular, a method for forming a metal housing of a conductive material on the exterior of a terminal has been used to protect the terminal from external impact and to emphasize more appealing design features of the product.

In the related art, a method that applies a conductive material as the exterior of the housing may include forming a thin conductive layer on a border surface of the housing plating, spraying, or printing, or forming a conductive layer in a continuous form using a metal material with a thickness equal to or thicker than 0.2 mm.

In the case of forming a thin conductive layer on the border surface of the housing, the surface conductive layer may peel off or split into pieces due to scratching, external impact, and the like, or by long or excessive use over time.

To address this problem, a method of using metal in the housing may be used. However, an electric current that flows to the antenna may induce current in the housing, thereby disturbing the transmission/reception of signals, and this may cause deterioration of the radiation efficiency of the antenna. Accordingly, the structure to which the method of forming the metal housing can be applied is limited, and to address this problem, a method of making the metal housing to serve as an antenna has been used.

Specifically, many antennas having a metal housing have loop antenna characteristics. The frequency characteristic may be expressed by an equation "frequency=wavelength/2". Accordingly, in the case of the antenna using the metal housing, the frequency characteristic is twice the frequency characteristic of a general dipole antenna "frequency=wavelength/4", and thus the length of the antenna should be twice the length of the dipole antenna to implement the same frequency band. For example, if it is intended to implement the band of 900 MHz, which is a low band, an electrical length of about 15 cm is required, and even in consideration of the time constant matching and the antenna connection structure, a conductive border of about 10 cm should be included in the structure that is effective in radiation.

Accordingly, if it is intended to implement an effective low-frequency band antenna in a general mobile terminal in the form of a loop antenna, a side surface, an upper surface, and a lower surface of the terminal should be used. Such disposition of the antenna causes the extension of a non-ground portion on the printed circuit board (PCB), which is unfavorable to component mounting on the PCB.

As a method for addressing such limitation, iPhone® 4G adopted a metal housing having a separated structure rather than a continuous ring, which implemented different antenna bands by the separated sections. However, if a user's finger or another conductive object touches a portion where the metal housing is separated, signal transmission/reception deteriorates or ceases, and this may cause problems for the exterior design of the terminal.

SUMMARY

In accordance with aspects of the present invention, there may be provided a terminal, which secures durability and design competitiveness and improves antenna performance through an application of a continuous conductive border, e.g., a loop-shaped metal frame. A terminal may include a multiband antenna using the conductive border, in which the conductive border that is connected to the antenna is used as a part of the antenna or a path that forms resonance.

A conductive border may be connected to the antenna so as to form a part of the antenna or to be used as the path of the transmission/reception signal. Accordingly, effective multiband antenna characteristics can be provided in a specific region of the terminal without changing the exterior of the terminal in a continuous conductive border environment. Further, by using the continuous conductive border, the terminal can be prevented from being damaged due to impact or the damage may be reduced, and the design competitiveness can be secured.

Additional features of the invention will be set forth in the description which follows, and in part will be apparent from the description, or may be learned by practice of the invention.

Exemplary embodiments of the present invention provide a mobile terminal, including: a wireless transmission/reception circuit to output a signal for a wireless communication of the mobile terminal; a conductive border that surrounds side surfaces of the mobile terminal; a ground element electrically connected to the conductive border; a first antenna element electrically connected to the conductive border and the wireless transmission/reception circuit; and a second antenna element electrically connected to the conductive border and the ground element.

Exemplary embodiments of the present invention provide a mobile terminal, including: a wireless transmission/reception circuit to output a signal for a wireless communication of the mobile terminal; a conductive border that surrounds side surfaces of the mobile terminal; a ground element electrically connected to the conductive border; a first antenna element electrically connected to at least one of the conductive border and the wireless transmission/reception circuit; and a connector that electrically connects the conductive border and the ground element and connects the conductive border and the wireless transmission/reception circuit to form another antenna.

Exemplary embodiments of the present invention provide a mobile terminal, including: a display screen disposed on a front surface of the mobile terminal; a wireless transmission/reception circuit to output a signal for a wireless communication of the mobile terminal; a conductive border disposed at a periphery of the front surface of the mobile terminal; a ground element electrically connected to a first location of the conductive border; a first antenna element electrically connected to a second location of the conductive border; and a second antenna element electrically connected to a third location of the conductive border.

Exemplary embodiments of the present invention provide a method for providing a multiband antenna using a conductive border, including: forming a housing of a mobile terminal; providing a conductive border on an exterior of the mobile terminal, the conductive border having a continuous conductive loop shape; providing a wireless transmission/reception circuit to output a signal for a wireless communication of a mobile terminal, the wireless transmission/reception circuit being disposed in the housing and electrically connected to a first location of the conductive border; and forming a ground element in the housing.

It is to be understood that both forgoing general descriptions and the following detailed description are exemplary and explanatory and are intended to provide further explanation of the invention as claimed. Other features and aspects will be apparent from the following detailed description, the drawings, and the claims.

BRIEF DESCRIPTION OF THE DRAWINGS

FIG. 15 is a table showing antenna gains of an antenna system including a first antenna, a second antenna, and a loop antenna according to an exemplary embodiment of the present invention.

DETAILED DESCRIPTION OF THE ILLUSTRATED EMBODIMENTS

Figure 1:
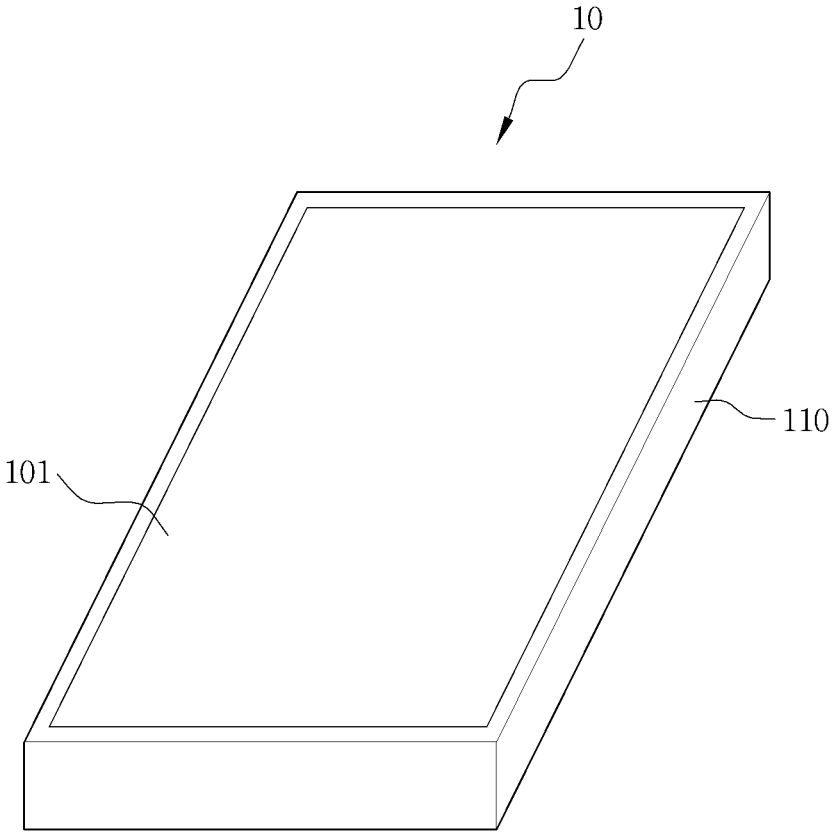
FIG. 1 is a perspective view illustrating the front exterior of a terminal according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. It will be understood that for the purposes of this disclosure, "at least one of X, Y, and Z" can be construed as X only, Y only, Z only, or any combination of two or more items X, Y, and Z (e.g., XYZ, XZ, XYY, YZ, ZZ). Throughout the drawings and the detailed description, unless otherwise described, the same drawing reference numerals are understood to refer to the same elements, features, and structures. The relative size and depiction of these elements may be exaggerated for clarity.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second", and the like does not imply any particular order, but they are included to identify individual elements. Moreover, the use of the terms first, second, etc. does not denote any order or importance, but rather the terms first, second, etc. are used to distinguish one element from another. It will be understood that when an element is referred to as being "connected to" another element, it can be directly connected to the other element, or intervening elements may be present It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Although some features may be described with respect to individual exemplary embodiments, aspects need not be limited thereto such that features from one or more exemplary embodiments may be combinable with other features from one or more exemplary embodiments.

Hereinafter, a terminal including a multiband antenna as a conductive border according to exemplary embodiments of the present disclosure will be described in further detail with reference to the accompanying drawings.

Figure 2:
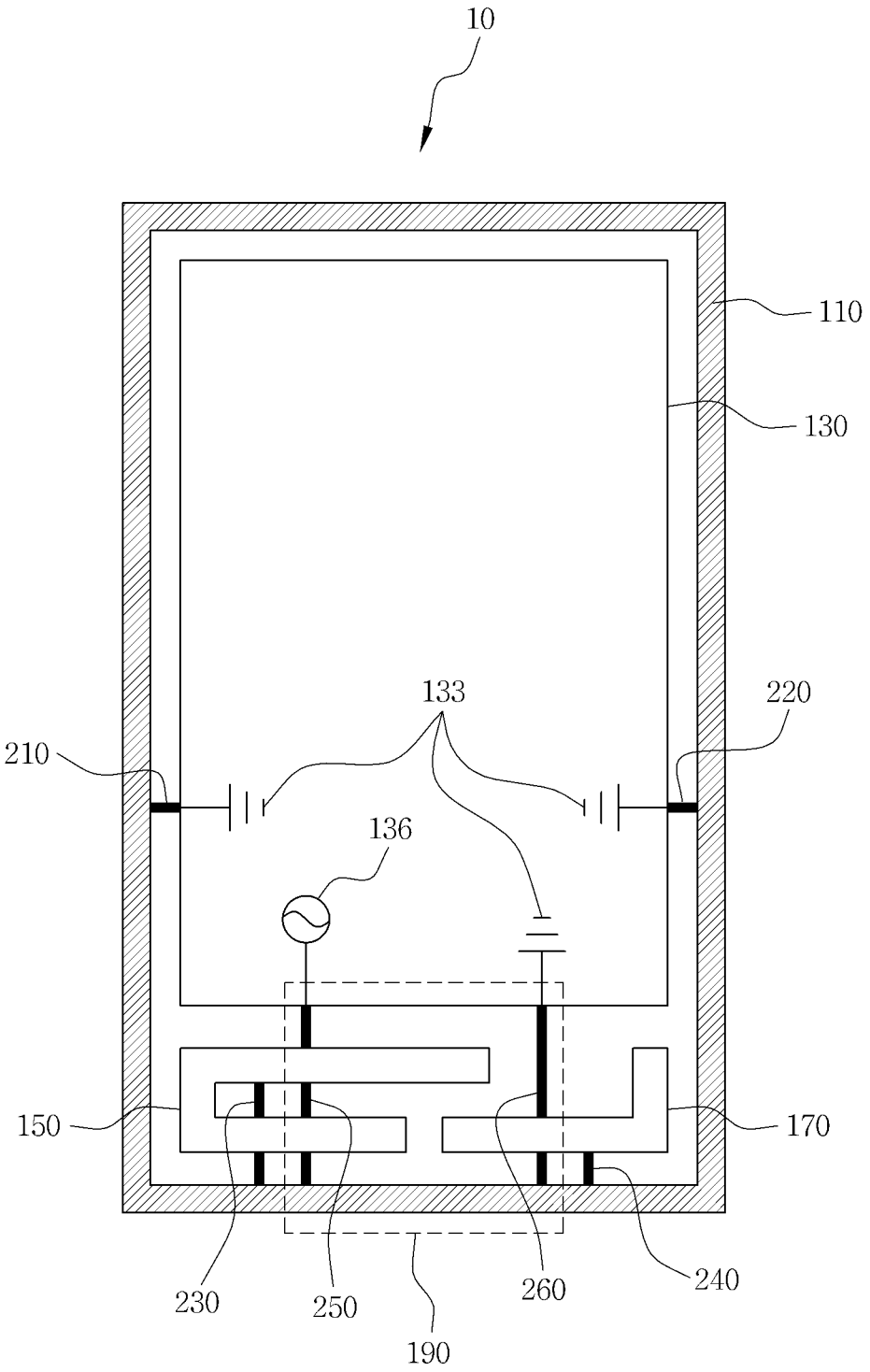
FIG. 2 is a plan view illustrating the configuration of an antenna system according to an exemplary embodiment of the present invention.

FIG. 1 is a perspective view illustrating the front exterior of a terminal according to an exemplary embodiment of the present invention. FIG. 2 is a plan view illustrating the configuration of an antenna system according to an exemplary embodiment of the present invention.

Referring to FIG. 1 and FIG. 2, a terminal 10 includes a display 101 disposed on one surface of the terminal 10, and a conductive border 110 surrounding the exterior of the terminal 10. The conductive border 110 may be a metal frame that surrounds or forms the side surfaces of the terminal 10, and may be configured to support a thin bezel of the terminal 10 or to protect the terminal 10 without a bezel. The side surfaces of the terminal 10 extend between the front surface and the back surface, at least one of which comprises a display, of the terminal 10. Further, the conductive border 110 may have a continuous loop shape and may substantially cover the side surfaces of the terminal 10 such that the side surfaces are protected from external impacts. For example, the side surfaces of a cuboid-shaped terminal may be covered, surrounded, or formed by a continuous loop-shaped metal frame, and the metal frame may surround the periphery of the front surface including the display 101 of the terminal 10.

The type of the terminal 10 may include various types of mobile communication devices, such as a smart phone, a mobile phone, a tablet computer, a laptop computer, a net book, a Personal Digital Assistance (PDA), a Portable Multimedia Player (PMP), a PlayStation® Portable (PSP®), an MP3 player, an e-book reader, a Global Positioning System for navigation, a smart camera, an electronic dictionary, an electronic watch, and the like.

The terminal 10 may execute various application programs based on the embedded operating systems (OS), which include operating systems that can be installed in mobile communication devices, such as Android™ OS, iOS® of Apple Inc., Windows® Mobile OS, Bada OS, Symbian OS, BlackBerry® OS, and the like.

The display 101 is a display region, and may include a liquid crystal display (LCD) panel, a plasma display panel (PDP), an organic light emitting diode (OLED), and the like.

Further, in order to process user inputs, a touch screen function may be included in the display 101 and/or may be provided as a separate touchpad device. Further, the terminal 10 may include an input device (not illustrated), which is disposed separately from the display 101 to receive a user input, such as a keypad.

The conductive border 110 may be formed to be connected in the form of a loop along one surface (e.g., side surfaces) of the terminal 10, and these features may provide durability as well as appealing structural design. The conductive border 110 may be disposed along each side of the terminal 10 so as to expose the front and back of the terminal 10. Further, the conductive border 110 may support the display 101 and a printed circuit board (PCB) 130, and protect the terminal from external physical impacts more effectively.

The conductive border 110 may be in the form of a ceaseless (continuous) ring or rectangular-shaped loop. However, aspects are not limited thereto, and the conductive border 110 may be formed such that partial regions of the conductive border 110 are discontinuous. The discontinuous region of the conductive border 110 may be formed in regions other than regions used for resonance formations and disposed between the first antenna element and the second antenna element to be described later. Specifically, regions in which at least the first antenna, the second antenna, and the third (loop) antenna are used for resonance formation (e.g., sections in which points are connected to respective connectors, e.g., connection wires 210, 220, 230, 240, 250, and 260), are connected in a continuous form. For example, a first portion of the conductive border 110 that forms an antenna for a wireless communication frequency band together with a first antenna element (e.g., an antenna pattern) may be configured as a continuous conductive form, a second portion of the conductive border 110 connected between the first antenna element and a second antenna element may be continuous such that the first antenna element and the second antenna element may be electrically connected via the second portion of the conductive border 110, and/or a third portion of the conductive border 110 that forms an antenna for a wireless communication frequency band together with the second antenna element may be configured as a continuous conductive form. Further, a region of the continuous border generally gripped by a user (e.g., a lower region of the terminal that is mainly gripped during calling) may be connected in a continuous form.

The conductive border 110 may have substantially the same thickness (or width) or may have at least one portion being thicker or thinner than another. Further, the conductive border 110 may be disposed to surround or cover at least one surface (e.g., a side surface or surfaces) of the terminal 10 as a whole (may be formed with the same thickness or width as the thickness or width of a side surface of the terminal), or may be disposed to surround a partial region of one surface of the terminal 10 (may be formed with a thickness or width that is smaller than the thickness or width of a side surface of the terminal). More than three portions of the conductive border 110 may be electrically connected to the ground 133 or other portions of the printed circuit board (PCB) including the ground 133. Further, in order to secure the connections of the connectors, e.g., the connection wires 210, 220, 250, and 260, one or more fixing members may be disposed on the PCB including the ground 133 such that the fixing members secure the connections of the connectors, e.g., C-clips, a connection wire, an L-clip, a flexible printed circuit board (FPCB), trace, screw, etc., between the conductive border 110 and the PCB. The fixing member may be insulative or non-conductive material attached to the PCB, or may be conductive material.

Further, the conductive border 110 is made of a material having electrical conductivity, such as metal, and is connected to the first antenna element 150, the second antenna element 170, and the third antenna 190 to form a part of the antennas or to be used as a path of a transmission/reception signal. The first antenna element 150 may be a first internal antenna pattern, and the second antenna element 170 may be a second internal antenna pattern.

Accordingly, the conductive border 110 connected to the first antenna element 150, the second antenna element 170, and the third antenna 190 can improve the performance of the antenna by providing multiband frequency and/or configuring a portion of the conductive border 110 to be connected to the first antenna element 150, the second antenna element 170, and the third antenna 190. The exemplary embodiments of the conductive border 110 will be described in detail with reference to FIG. 3 to FIG. 9.

In the internal space of the terminal 10, the printed circuit board 130, the first antenna element 150, and the second antenna element 170 may be disposed. In the internal space of the terminal 10, the third antenna 190 may be further formed. Further, the antenna system of the terminal 10 may include at least one of the first antenna element 150, the second antenna element 170, and the third antenna 190.

On the printed circuit board 130, a wireless transmission/reception circuit that outputs the transmission/reception signal for communication of the terminal 10 and a ground 133 are disposed. Each antenna may be connected to the ground 133 to ground the transmission/reception signal. The printed circuit board 130 may be formed as a single layer or a multi-layer including a dual layer.

In order to enhance the mechanical coupling with the housing, the conductive border 110 may be connected to the ground 133 through the connectors (e.g., connection wires or connection clips) 210 and 220. For the performance related to the antenna, the conductive border 110 may be connected to the first antenna element 150 and the second antenna element 170 through the connectors 230 and 240, respectively, and may be connected to the wireless transmission/reception circuit 136 and the ground 133 through the connectors 250 and 260, respectively.

The first antenna element 150 may be connected to the conductive border 110 and the wireless transmission/reception circuit 136. Specifically, the first antenna element 150 is connected to the wireless transmission/reception circuit 136 through the connection wire 250, and is connected to the conductive border 110 through the connection wire 230.

The second antenna element 170 may be connected to the conductive border 110 and the ground 133. Specifically, the second antenna element 170 is connected to the ground 133 through the connection wire 260, and is connected to the conductive border 110 through the connection wire 240.

The connectors, e.g., connection wires 210, 220, 230, 240, 250, and 260, are conductive members, and may include a trace and an FPCB, and may include at least one of mechanical coupling members, such as a C-clip, an L-clip, and a screw, a connection wire, an FPCB, trace, etc.

Referring to FIG. 2, the first antenna element 150 is configured to be connected to the wireless transmission/reception circuit 136, and the second antenna element 170 is configured to be connected to the ground 133. However, aspects are not limited thereto, the first antenna element 150 may be directly connected to the ground 133, and the second antenna element 170 may be connected to the wireless transmission/reception circuit 136. Further, a separate ground that is directly connected to the first antenna element 150 may be additionally provided in addition to the ground 133, or a separate wireless transmission/reception circuit (not shown) that is directly connected to the second antenna element 170 may be additionally provided in addition to the wireless transmission/reception circuit 136. In this case, the respective wireless transmission/reception circuit may output transmission/reception signals that match the corresponding frequency band supported by the first antenna and the second antenna. As described above, the connection of the antenna to other elements may be changed depending on the communication method or the configuration of a frequency band.

Hereinafter, referring to FIG. 3 to FIG. 5, the first antenna element 150 will be described in detail.

Figure 3:
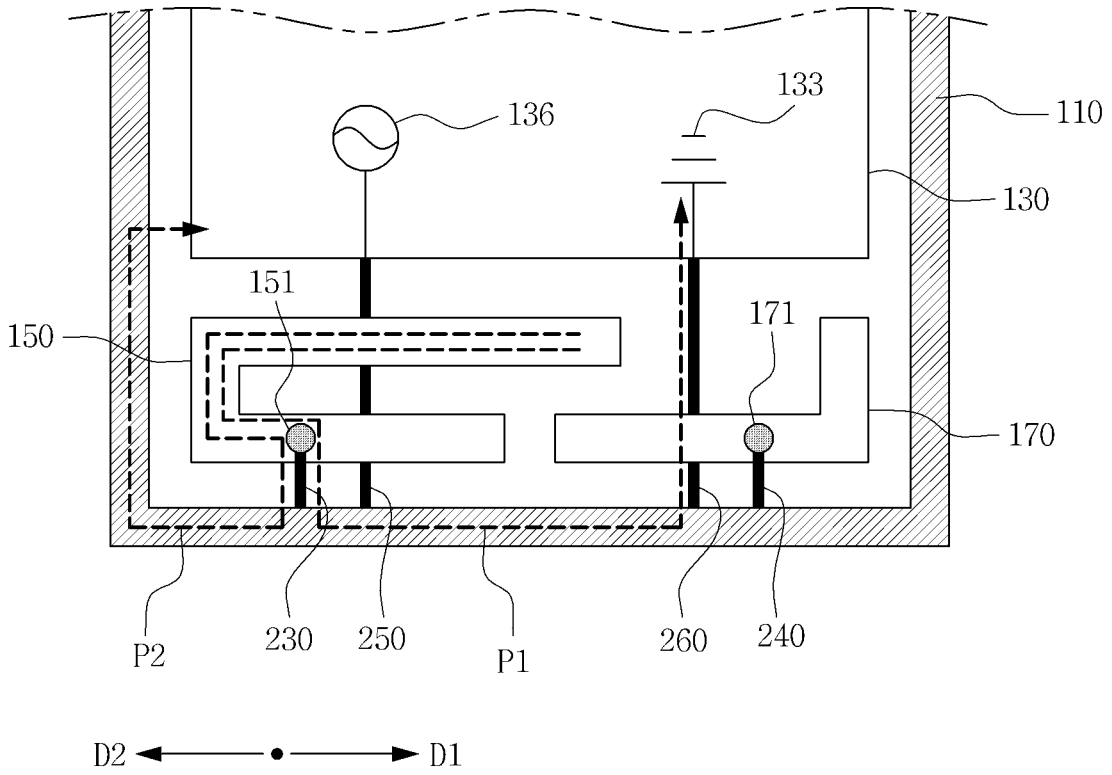
FIG. 3 is a conceptual view showing paths for forming low-band and high-band resonance occurring in a first antenna of FIG. 2 according to an exemplary embodiment of the present invention.
Figure 4A:
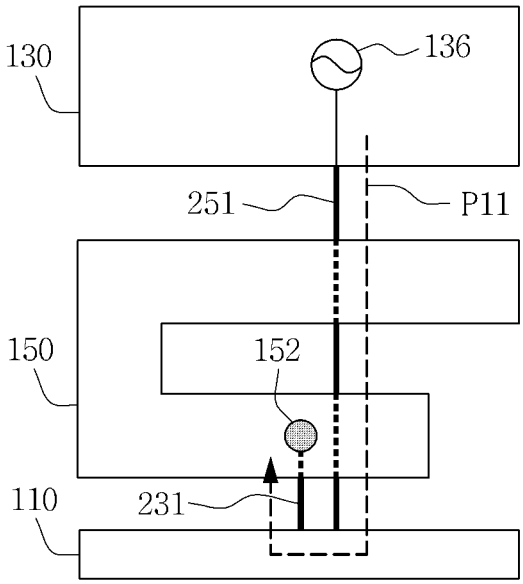
FIG. 4A, FIG. 4B, and FIG. 4C are partial plan views showing examples of a connection method of the first antenna of FIG. 2 according to an exemplary embodiment of the present invention.
Figure 4B:
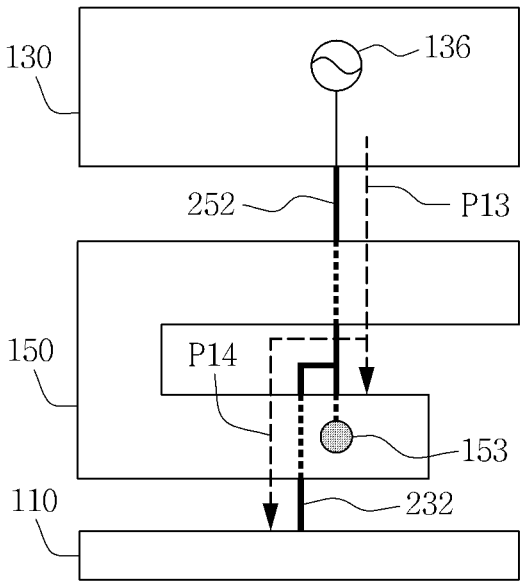
Figure 4C:
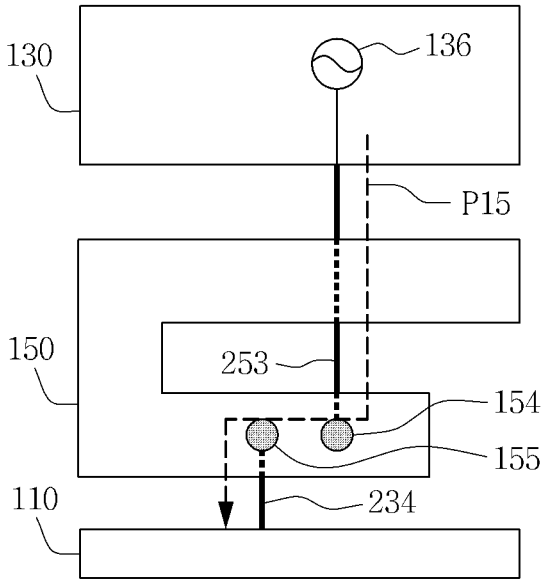

FIG. 3 is a conceptual view showing paths for forming low-band and high-band resonance occurring in the first antenna of FIG. 2 according to an exemplary embodiment of the present invention. FIG. 4A, FIG. 4B, and FIG. 4C are partial plan views showing examples of a connection method of the first antenna of FIG. 2 according to an exemplary embodiment of the present invention. FIG. 5 is a partial plan view showing an example of contacts between the first antenna of FIG. 2 and connection wires according to an exemplary embodiment of the present invention.

Referring to FIG. 3, the first antenna element 150 is electrically connected to a first portion of the conductive border 110 through the connector 230, and the first portion of the conductive border 110 is electrically connected to the wireless transmission/reception circuit 136 through the connector 250. A contact portion where the first antenna element 150 and the conductive border 110 are connected to each other is defined as a first contact 151.

The first antenna element 150 is connected to the conductive border 110, and resonance is formed by a first path P1 and a second path P2, which associated with one end of the first antenna element 150.

The first path P1 is a path, which starts from one end of the first antenna element 150 and reaches the ground 133 through the first contact 151, the connection wire 230, and the conductive border 110 in a first direction D1. The first path P1 may reach the ground 133 after passing through the conductive border 110 and the connection wire 260.

The second path P2 is a path, which starts from one end of the first antenna element 150 and reaches the ground through the first contact 151, the connection wire 230, and the conductive border 110 in a second direction D2. The second direction D2 may be opposite to the first direction D1. In FIG. 3, the second path P2 may not be connected to the ground through the connection wire. However, if the ground and a portion of the conductive border 110 are close to each other and alternating current (AC) is applied, the effect is substantially similar as the effect caused when the portion of the conductive border 110 is grounded. The ground may include a ground element of a conductive material and a portion of the conductive material may be disposed in proximity to a portion of the conductive border 110 to form a capacitor. When a high frequency AC current is applied through the conductive border 110, the capacitor may be similar to a short circuit and the portion of the conductive border 110 may not need to physically contact the ground to produce a similar antenna property.

As a result, each of the first path P1 and the second path P2 are formed as paths in which on end of the first antenna element 150 is electrically connected to the ground through the conductive border 110.

Resonance frequencies are generated by the first path P1 and the second path P2 in association with the first antenna element 150. The first antenna element 150 may be formed with a length that is relatively longer than the second antenna element 170, and in this case, the first antenna element 150 may generate relatively low-band resonance in comparison with the second antenna element 170. The first antenna may be an antenna formed by elements including the first antenna element 150 and a portion of the conductive border 110 and the antenna properties may be determined based on the paths P1 and P2.

Further, through the two paths P1 and P2 having different lengths, not only low-band resonance by the long path but also high-band resonance by the short path can be formed. More specifically, the first antenna element 150 may generate the low-band resonance along one path connected to the conductive border 110 and may form the high-band resonance along another path. For example, the low-band frequency may be equal to or lower than about 900 MHz, and the high-band frequency may be equal to or higher than about 1700 MHz.

As described above, since the first antenna element 150 generates both the low-band resonance and the high-band resonance, it may function as a main antenna in the antenna system of the terminal 10. Accordingly, if the first antenna element 150 functions as the main antenna, it may affect the whole antenna performance of the terminal 10, and thus the wireless transmission/reception circuit 136 may be connected to the first antenna element 150. As shown in FIG. 3, the wireless transmission/reception circuit 136 may be directly connected to the first antenna element 150 via a connector, e.g., a C-clip, a connection wire, an L-clip, an FPCB, trace, screw, etc., without other intervening elements, such as the conductive border 110 and the second antenna element 170.

The size and the bandwidth of the resonance frequency of the first antenna element 150 can be adjusted according to the length and the pattern shape of the first antenna element 150 and the connection type between the conductive border 110 and the wireless transmission/reception circuit 136. Accordingly, the first antenna element 150 illustrated in FIG. 3 is an exemplary illustration, and may be designed in different structures.

Referring to FIG. 4A to FIG. 4C, the first antenna element 150, the conductive border 110, and the wireless transmission/reception circuit 136 may be connected to each other in various ways.

As illustrated in FIG. 4A, a connection wire 251 may connect the wireless transmission/reception circuit 136 and the conductive border 110, and a connection wire 231 may connect the conductive border 110 and the first antenna element 150. The connection wire 231 and the first antenna element 150 may be connected to each other through a first contact 152.

In this case, the transmission/reception signal that is output from the wireless transmission/reception circuit 136 first reaches the conductive border 110 along a path P11, and then is input to the first antenna element 150 through the conductive border 110.

As another example, as illustrated in FIG. 4B, a connection wire 252 may be branched to a connection wire 232 before the connection wire 252 connects the wireless transmission/reception circuit 136 and the first antenna element 150, and the connection wires 252 and 232 may connect the first antenna element 150 and the conductive border 110 to the wireless transmission/reception circuit 136. The connection wire 252 and the first antenna element 150 may be connected to each other through the first contact 153.

In this case, the transmission/reception signal that is output from the wireless transmission/reception circuit 136 is input to the first antenna element 150 through a path P13, and is input to the conductive border 110 along a path P14 that is branched from the path P13.

As another example, as illustrated in FIG. 4C, a connection wire 253 may connect the wireless transmission/reception circuit 136 and the first antenna element 150, and a connection wire 234 may connect the conductive border 110 and the first antenna element 150. The connection wire 253 and the first antenna element 150 may be connected to each other through a contact 154, and the connection wire 234 and the first antenna element 150 may be connected to each other through a contact 155.

In this case, the transmission/reception signal that is output from the wireless transmission/reception circuit 136 is input to the first antenna element 150 along a path P15, and then is input to the conductive border 110 through the first antenna element 150.

The connections of the wireless transmission/reception circuit 136, the conductive border 110, and the first antenna element 150 as illustrated in FIG. 4A to FIG. 4C are exemplary, and may be designed in different structures.

Figure 5:
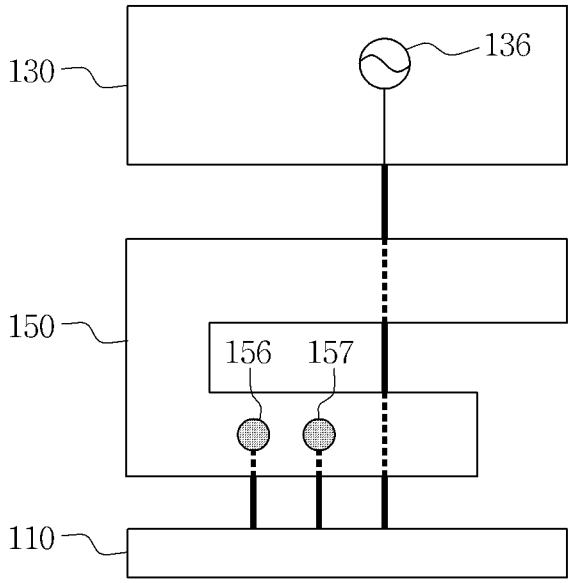
FIG. 5 is a partial plan view showing an example of contacts between the first antenna of FIG. 2 and connection wires according to an exemplary embodiment of the present invention.

Further, as illustrated in FIG. 5, two or more first contacts 156 and 157 for connecting the connection wire and the first antenna element 150 may be provided, and may be designed in various forms to increase the bandwidth.

Hereinafter, referring to FIG. 6 to FIG. 8, the second antenna formed by the second antenna element 170 will be described in detail.

Figure 6:
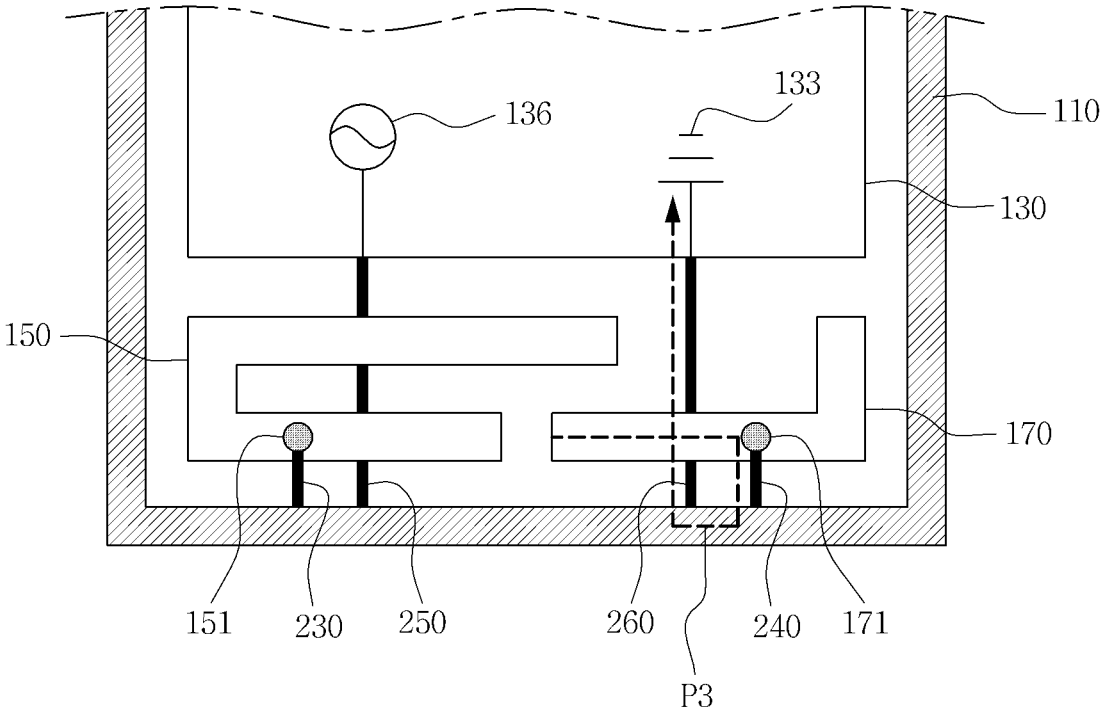
FIG. 6 is a conceptual view showing a path for forming high-band resonance occurring in a second antenna of FIG. 2 according to an exemplary embodiment of the present invention.
Figure 7A:
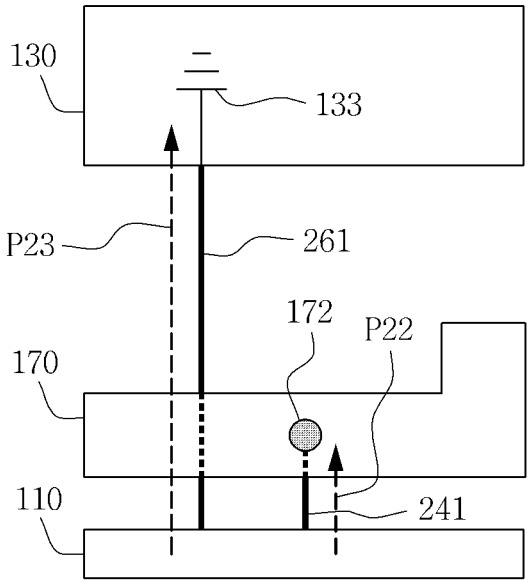
FIG. 7A, FIG. 7B, and FIG. 7C are plan views showing examples of a connection method of the second antenna of FIG. 2 according to an exemplary embodiment of the present invention.
Figure 7B:
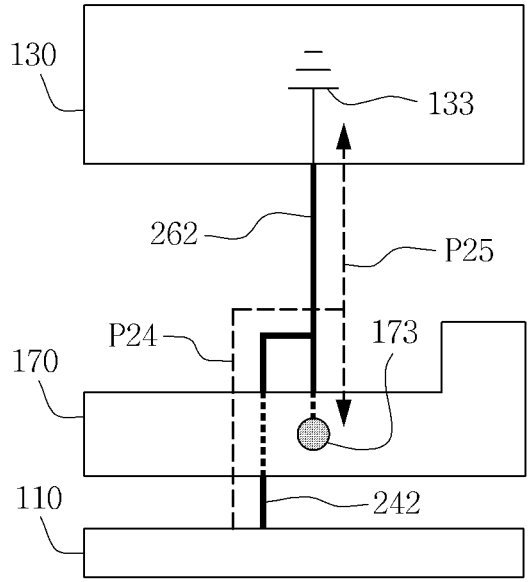
Figure 7C:
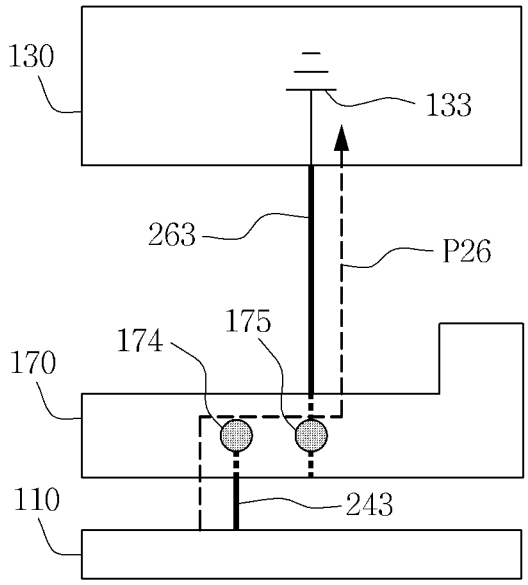

FIG. 6 is a conceptual view showing a path for forming high-band resonance occurring in the second antenna of FIG. 2 according to an exemplary embodiment of the present invention. FIG. 7A to FIG. 7C are partial plan views showing examples of a connection method of the second antenna of FIG. 2 according to an exemplary embodiment of the present invention. FIG. 8 is a partial plan view showing an example of contacts between the second antenna of FIG. 2 and connection wires according to an exemplary embodiment of the present invention.

Referring to FIG. 6, the second antenna element 170 is electrically connected to the conductive border 110 and the ground 133 through the connection wires 240 and 260, respectively. A portion where the second antenna element 170 and the connection wire 240 are connected to each other is defined as a second contact 171. The second antenna is formed by elements including the second antenna element 170 and a portion of the conductive border 110.

The second antenna element 170 is connected to the conductive border 110, and resonance is formed by a path P3 through the conductive border 110. The path P3 is a path, which starts from one end of the second antenna element 170 and reaches the ground 133 through the second contact 171, the connection wire 240, the conductive border 110, and the connection wire 260. Unless there is a shorter path, which starts from the conductive border 110 and reaches the ground 133, resonance is formed by the path P3 in the second antenna element 170.

The second antenna element 170 has a length that is relatively shorter than the first antenna element 150, and thus the second antenna may generate the high-band resonance in comparison with the first antenna. Accordingly, the second antenna may additionally generate high-band frequency that is different from the high band occurring in the first antenna. Through this, the second antenna may function as an auxiliary antenna that supports the first antenna, and the multiband and wide-band frequencies can be formed.

The size and the bandwidth of the resonance frequency of the second antenna element 170 can be adjusted according to the length and the pattern shape of the second antenna element 170 and the connection type between the conductive border 110 and the ground 133. Accordingly, the second antenna element 170 illustrated in FIG. 6 is exemplary, and may be designed in different structures.

Referring to FIG. 7A to FIG. 7C, the second antenna element 170, the conductive border 110, and the ground 133 may be connected to each other in various ways. As shown in FIG. 6, if the second antenna element 170 is not directly connected to the wireless transmission/reception circuit 136, the transmission/reception signal that is output from the wireless transmission/reception circuit 136 is input to the second antenna element 170 through the connection wire 250 and the conductive border 110.

As illustrated in FIG. 7A, a connection wire 241 may connect the conductive border 110 and the second antenna element 170, and a connection wire 261 may connect the conductive border 110 and the ground 133. The second antenna element 170 and the connection wire 241 may be connected to each other through a second contact 172.

The transmission/reception signal that is output from the wireless transmission/reception circuit 136 is input from the conductive border 110 to the second antenna element 170 along a path P22, and is input from the conductive border 110 to the ground 133 along a separate path P23.

As another example, as illustrated in FIG. 7B, a connection wire 262 may be branched to a connection wire 242 before the connection wire 262 connects the second antenna element 170 and the ground 133, and the connection wires 242 and 262 may connect the conductive border 110 to the second antenna element 170 and the ground 133. The connection wire 262 and the second antenna element 170 may be connected to each other through the second contact 173.

The transmission/reception signal that is output from the wireless transmission/reception circuit 136 is input from the conductive border 110 to the second antenna element 170 along a path P24, and is input from the path P24 to the ground 133 along a path P25 that is branched from the path P24.

As another example, as illustrated in FIG. 7C, a connection wire 243 may connect the conductive border 110 and the second antenna element 170, and a connection wire 263 may connect the second antenna element 170 and the ground 133. The connection wire 243 and the second antenna element 170 may be connected to each other through a contact 174, and the connection wire 263 and the second antenna element 170 may be connected to each other through a contact 175.

The transmission/reception signal that is output from the wireless transmission/reception circuit 136 is input from the conductive border 110 to the second antenna element 170 along a path P26, and is input to the ground 133 through the second antenna element 170.

The connections of the ground 133, the conductive border 110, and the second antenna element 170 as illustrated in FIG. 7A to FIG. 7C are exemplary, and may be designed in different structures.

Figure 8:
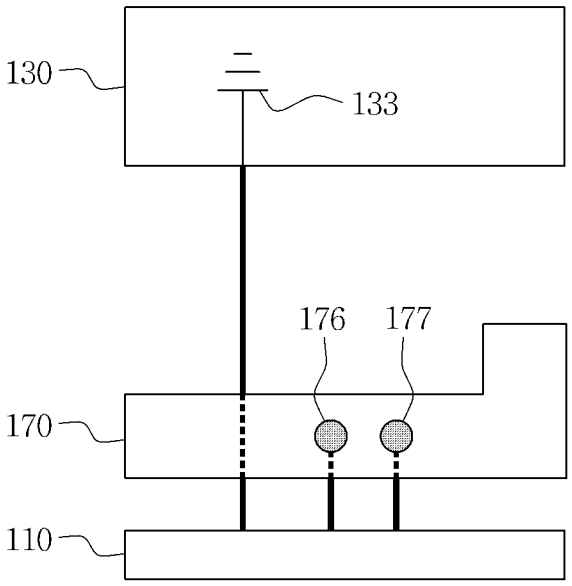
FIG. 8 is a plan view showing an example of contacts between the second antenna of FIG. 2 and connection wires according to an exemplary embodiment of the present invention.

Further, as illustrated in FIG. 8, two or more contacts 176 and 177 for connecting the connection wire and the second antenna element 170 may be provided, and may be designed in various forms to increase the bandwidth. More specifically, the connection wire 176 may electrically connect a first portion of the second antenna element 170 and a first portion of the conductive border 110. The connection wire 177 may electrically connect a second portion of the second antenna element 170 and a second portion of the conductive border 110.

Hereinafter, referring to FIG. 9, the third antenna 190 will be described in detail.

Figure 9:
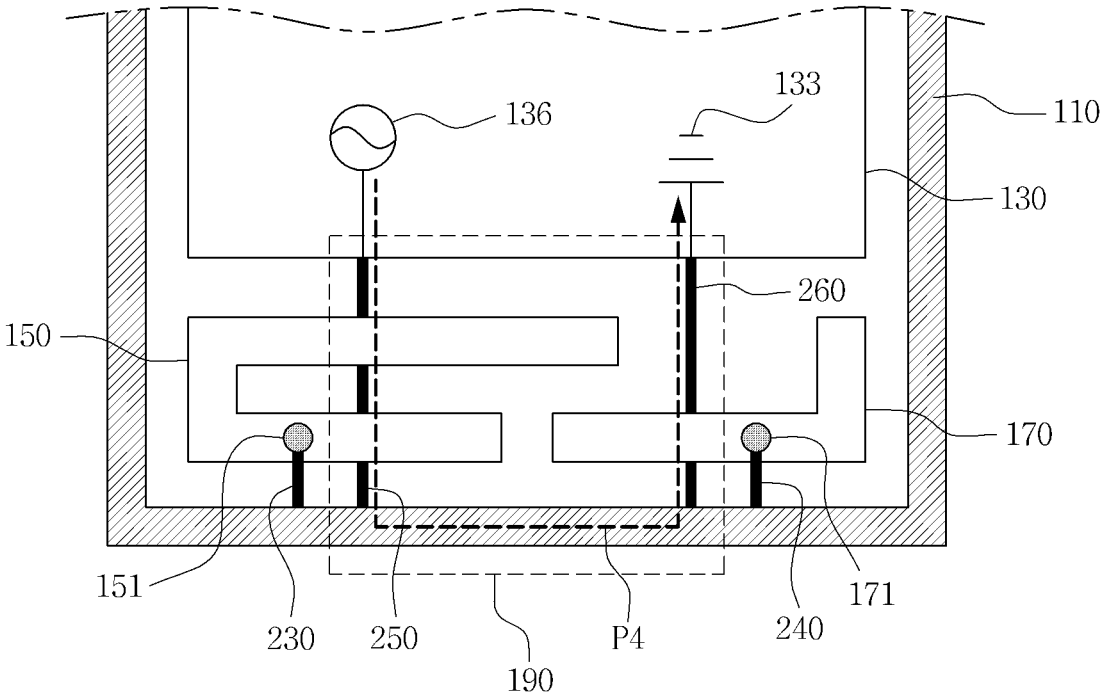
FIG. 9 is a conceptual view showing a path for forming resonance occurring in a third antenna of FIG. 2 according to an exemplary embodiment of the present invention.

FIG. 9 is a conceptual view showing a path for forming resonance occurring in the third antenna of FIG. 2 according to an exemplary embodiment of the present invention.

Referring to FIG. 9, the antenna system of the terminal 10 may include two or more antennas including antennas formed by the first antenna element 150 and the second antenna element 170, and may further include the third antenna 190 configured by the conductive border and connectors.

The third antenna 190 may be formed by the wireless transmission/reception circuit 136, the conductive border 110, and the ground 133, which are connected by the connection wires 250 and 260, respectively, and may be in the form of a loop antenna.

The third antenna 190 generates resonance by a path P4 through the conductive border 110. The path P4 is a path through which the transmission/reception signal that is output from the wireless transmission/reception circuit 136 is transferred to the conductive border 110 through the connection wire 250, and reaches the ground 133 through the connection wire 260.

The third antenna 190 may form high-band or low-band resonance, and may form a band frequency that is different from the high-band or low-band generated by the first antenna element 150 and the second antenna element 170. Accordingly, the third antenna 190 may extend the bandwidth provided by the first antenna element 150 and the second antenna 170, and improve the performance of the antenna system of the terminal 10.

The size and the bandwidth of the resonance frequency of the third antenna 190 can be adjusted according to the length and the pattern shape of the third antenna 190 and the connection type between the conductive border 110 and the ground 133. The third antenna 190 illustrated in FIG. 9 is exemplary, and may be designed in different structures.

Figure 10:
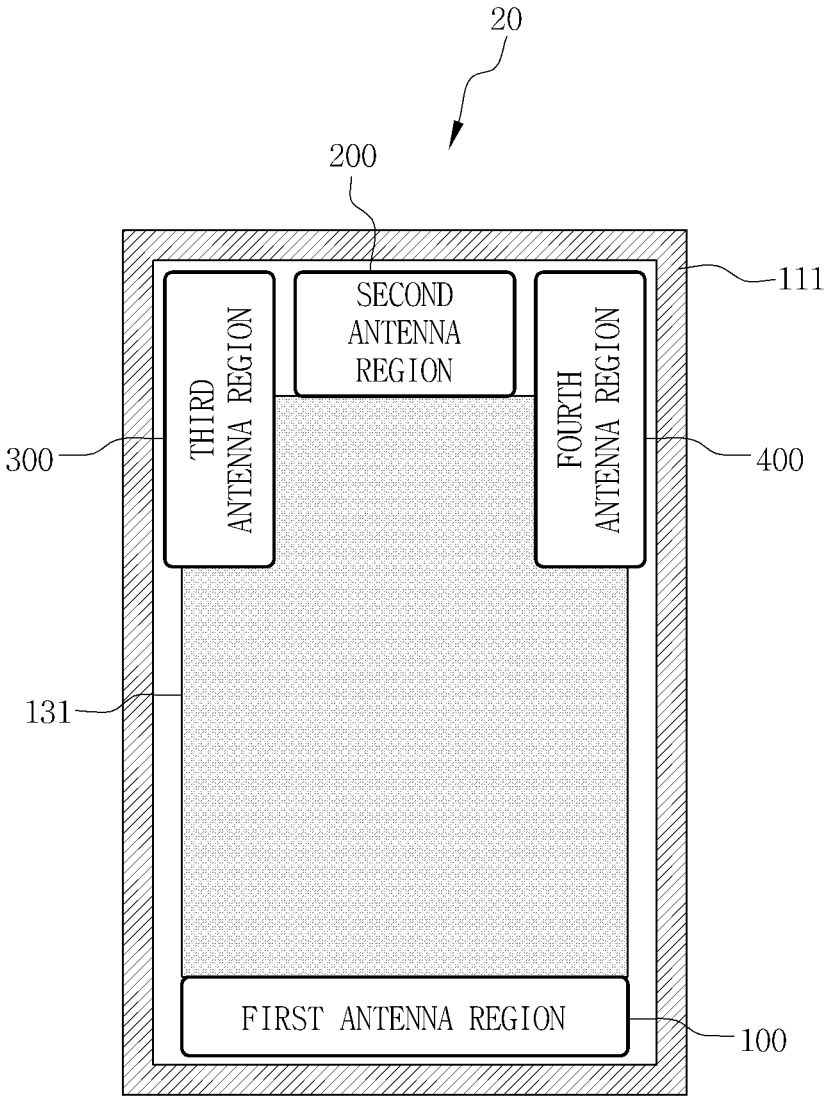
FIG. 10 is a plan view illustrating the configuration of an antenna system according to an exemplary embodiment of the present invention.

FIG. 10 is a plan view illustrating the configuration of an antenna system according to an exemplary embodiment of the present invention.

Referring to FIG. 10, a terminal 20 has a conductive border 111 that surrounds the exterior sides, as opposed to the front and back, of the terminal 20, and a printed circuit board 131 and one or more antenna regions 100, 200, 300, and 400 are provided in the internal space of the terminal 20.

For example, the first antenna element 150 and the second antenna element 170 illustrated in FIG. 2 may be disposed in the first antenna region 100 to provide a multiband antenna, and different band frequencies may be provided in the second antenna region 200, the third antenna region 300, and the fourth antenna region 400 to support the different communication methods for different frequency bands.

As one example, the second antenna region 200 may be provided as an antenna for MIMO (Multiple-Input Multiple-Output) communication, and the third antenna region 300 and the fourth antenna region 400 may be provided as an antenna for Global Positioning System (GPS) communication and Wi-Fi communication, respectively.

As another example, the antenna regions 100, 200, 300, and 400 may be configured using a part of or the entire portions of the first antenna, the second antenna, and the third antenna 190 illustrated in FIG. 2, and a fourth antenna may be additionally provided.

Further, not only the antenna configured in the first antenna region 100 but also the antennas configured in the second to fourth antenna regions 200, 300, and 400 may be connected to the conductive border 111.

Hereinafter, referring to FIG. 11 to FIG. 15, VSWR characteristics and advantageous effects of the antenna structure according to the present disclosure in forming the multiband resonance will be described. In the configurations, the terminal uses the low-band frequency in the range of about 800 MHz to 900 MHz, and uses the high-band frequency in the range of about 1700 MHz to 2200 MHz.

Figure 11:
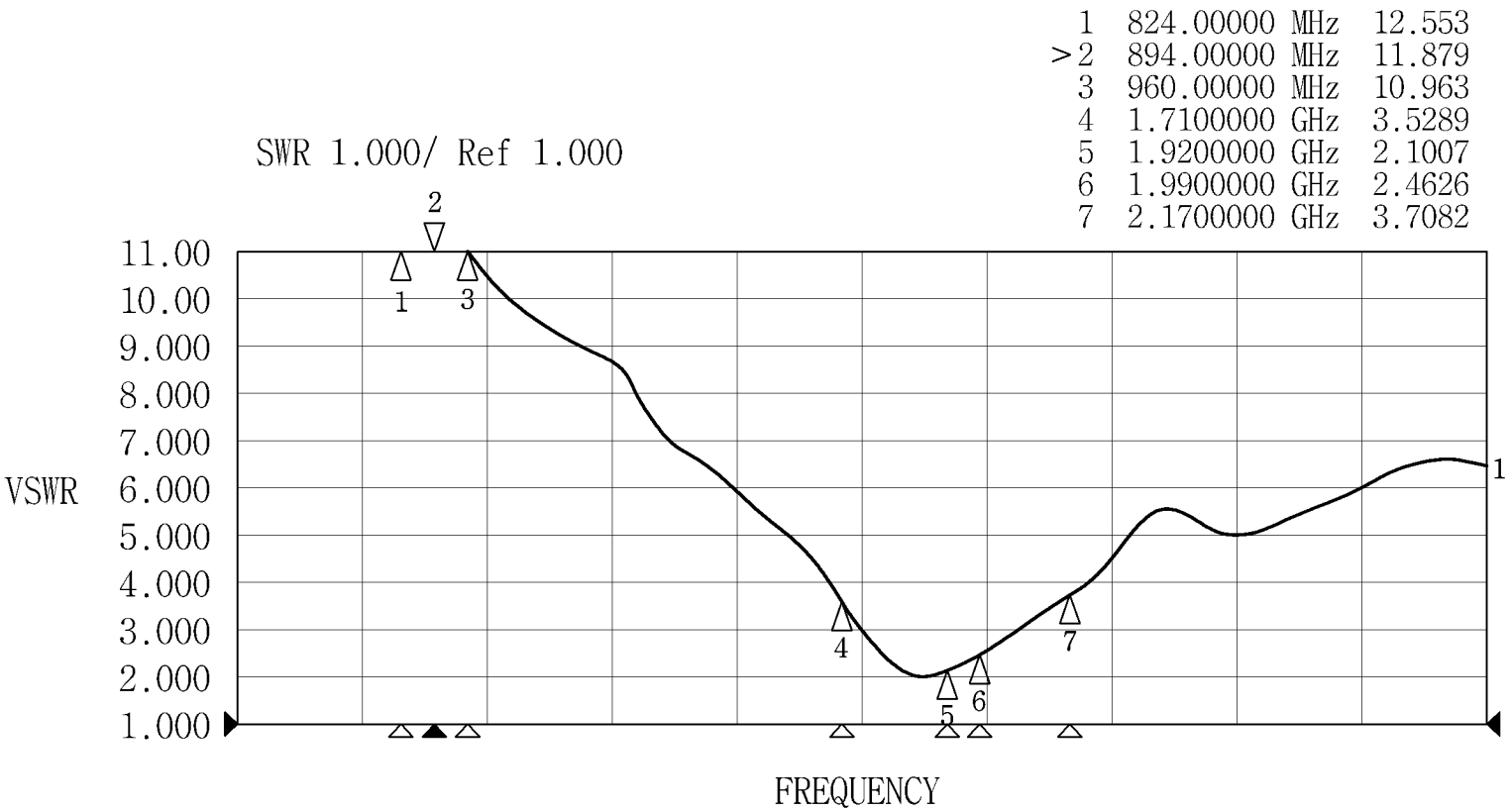
FIG. 11 is a graph showing the Voltage Standing Wave Ratio (VSWR) characteristics in a case where the third antenna is configured according to an exemplary embodiment of the present invention.
Figure 12:
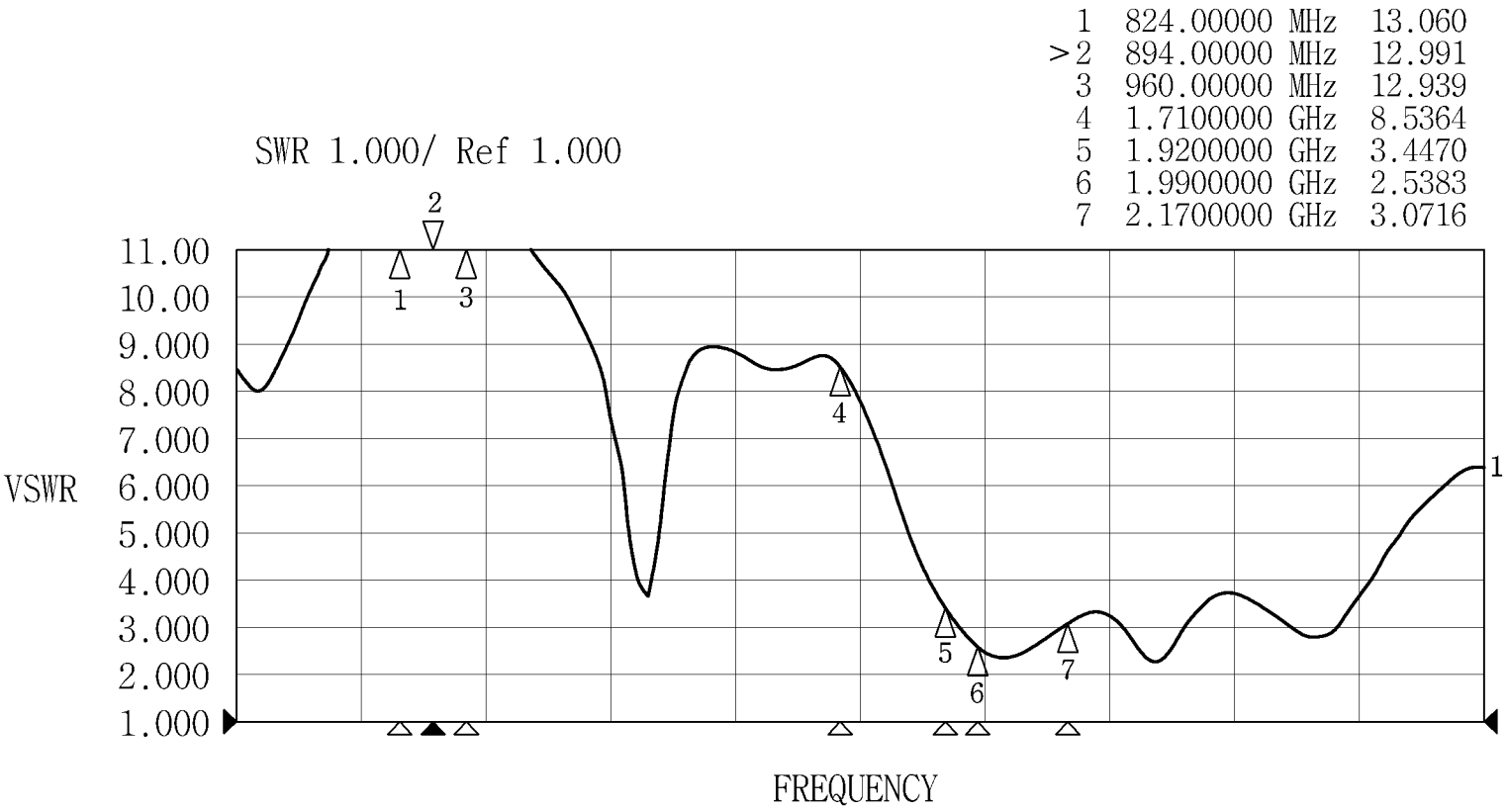
FIG. 12 is a graph showing the VSWR characteristics in a case where a typical antenna is configured in a structure that adopts a conductive border.
Figure 13:
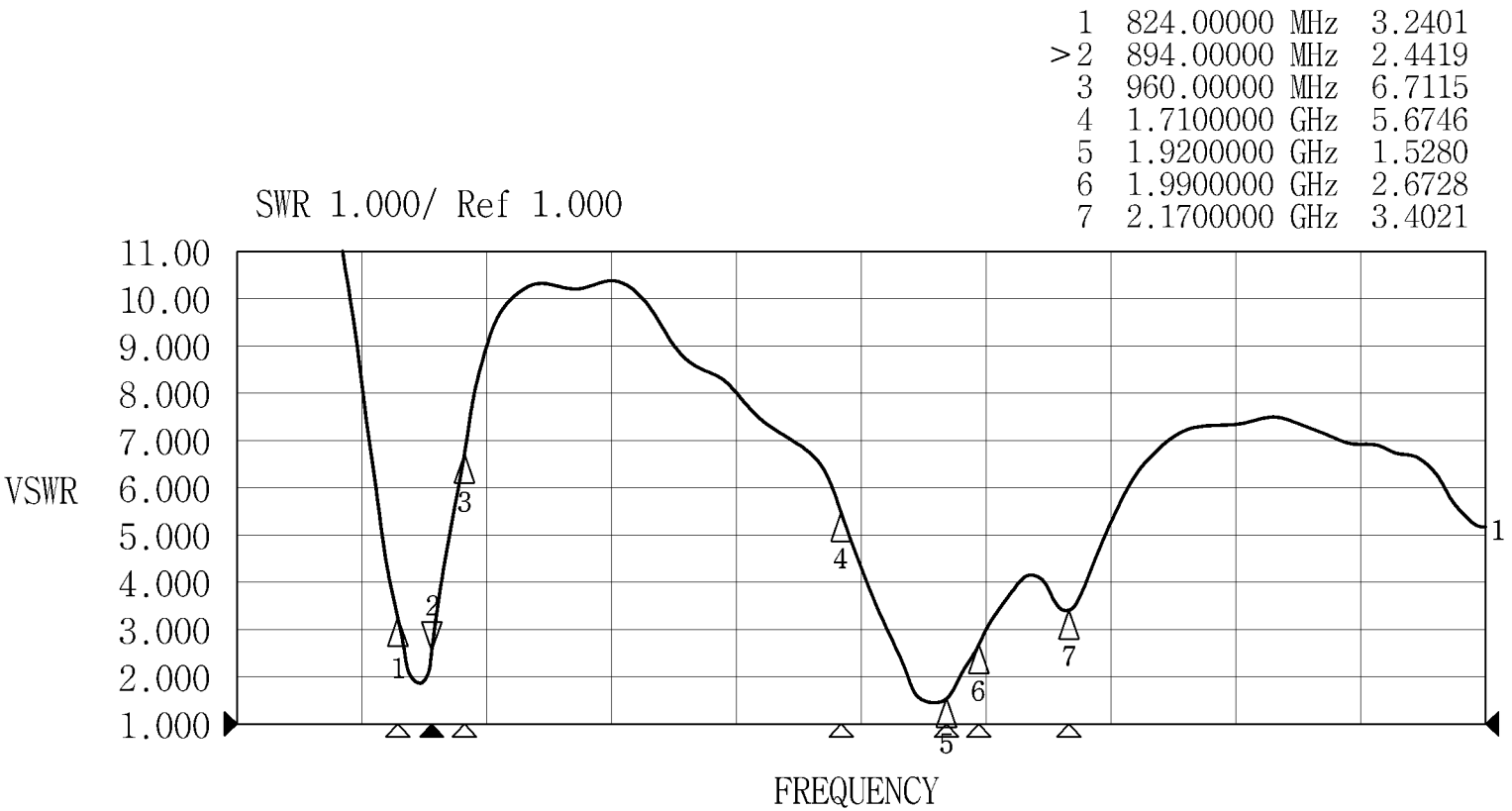
FIG. 13 is a graph showing the VSWR characteristics in a case where a conductive border and an antenna are connected to each other in a structure that adopts a conductive border.

FIG. 11 is a graph showing the VSWR characteristics in a case where the third antenna is configured according to an exemplary embodiment of the present invention. FIG. 12 is a graph showing the VSWR characteristics in a case where a typical antenna is configured in a structure that adopts a conductive border. FIG. 13 is a graph showing the VSWR characteristics in a case where a conductive border and an antenna are connected to each other in a structure that adopts a conductive border.

Referring to FIG. 11, the VSWR characteristics in the case where only the third antenna 190 of FIG. 2 is included in the typical terminal structure is shown. As shown in FIG. 11, resonance is not formed in the low band due to the size of the terminal and the length of the path through which the transmission/reception signal flows, and resonance is formed in the high band with a bad antenna gain.

Referring to FIG. 12, the VSWR characteristics in the case where the typical antenna structure is applied to the structure that adopts the conductive border is shown. In the structure where only the conductive border 110 of FIG. 2 and the first antenna element 150 are provided, the conductive border 110 and the first antenna element 150 are not connected to each other, and the wireless transmission/reception circuit 136 is connected to the first antenna element 150 only. In this case, the conductive border 110 serves as an extended ground, and the low-band resonance is not formed.

Referring to FIG. 13, the VSWR characteristics in the case where the antenna is connected to the conductive border in the structure where the conductive border is provided is shown. These characteristics correspond to a case where the conductive border 110 of FIG. 2, the first antenna element 150, and the third antenna 190 are formed without the second antenna 170. In this case, the low-band resonance is formed, but wide bandwidth is not secured in the high band.

Figure 14:
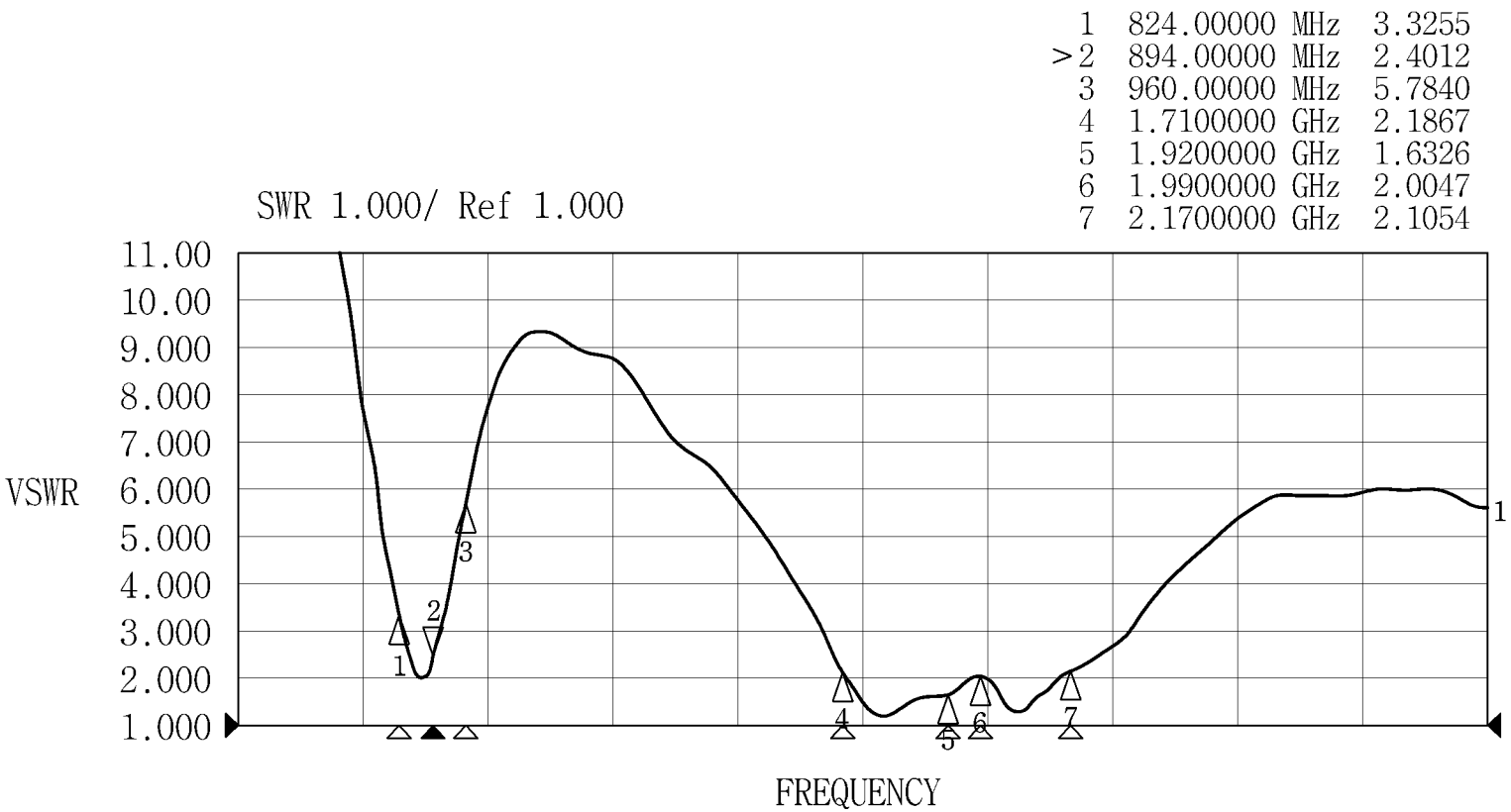
FIG. 14 is a graph showing the VSWR characteristics of an antenna system including a first antenna, a second antenna, and a loop antenna according to an exemplary embodiment of the present invention.

FIG. 14 is a graph showing the VSWR characteristics of an antenna system including a first antenna, a second antenna, and a loop antenna according to an exemplary embodiment of the present invention. FIG. 15 is a table showing antenna gains of an antenna system including a first antenna, a second antenna, and a loop antenna according to an exemplary embodiment of the present invention.

Referring to FIG. 14 and FIG. 15, the VSWR characteristics in the antenna structure according to an exemplary embodiment of the present invention is shown. The multiband performance can be secured by forming the low-band resonance with the first antenna of FIG. 2, and forming the high-band resonance with the second antenna and the third antenna 190.

More specifically, in the high band, the multiband and the wide band can be supported through forming plural resonances in a "W" form, and the antenna performance can be improved through improvement of the VSWR characteristics.

In the present disclosure, it is explained that the second antenna or the third antenna extend the high band in a state where the first antenna supports the low band and the high band. However, it is also possible to extend the low band through the configurations of the second antenna or the third antenna.

If two or more connectors are connected to the first antenna element 150 and the conductive border 110, e.g., as shown in FIG. 5, the location of the connectors, the number of connectors, and/or the distance between the connectors, e.g., the connector connected to the contact 156 and the connector connected to the contact 157, may determine different wireless communication frequency band characteristics. Further, the distance between the connector 210 and the connector 230 or 250 or the distance between the connector 220 and the connector 240 or 260 may also determine a wireless communication frequency band characteristic. The distance between the connector 250 and the connector 260 may determine a loop antenna characteristic.

Further, some connectors may be electrically connected to all or each of the conductive border 110, the wireless transmission/reception circuit 136, and the first antenna element 150, and other connectors may be connected to only one or two of the conductive border 110, the wireless transmission/reception circuit 136, and the first antenna element 150. Some connectors may be electrically connected to all or each of the conductive border 110, the ground element 133, and the second antenna element 170, and other connectors may be connected to only one or two of the conductive border 110, the ground element 133, and the second antenna element 170. Some connectors may electrically connect the conductive border 110 and a ground element without having an intervening conductive element or with an intervening conductive element. Different connection configurations of the connectors change wireless communication frequency band characteristics.

For example, the connector 210 or other connectors may include a conductive screw that may physically connect the conductive border 110 and the housing of which side surfaces are surrounded by the conductive border 110. The connector 210 may electrically connect a first location of the conductive border 110 and the ground 133 formed on the housing.

Some connectors, such as connectors 230 and 250, may include at least one of a conductive screw, an L-shaped connector, a C-Clip, and a trace formed on a printed circuit board (PCB). The connectors may include a conductive screw that physically connects the conductive border 110, an L-shaped conductive connector (e.g., L-shaped connectors 1616 and 1617 illustrated in FIG. 16A or L-clips) via a conductive screw. The connectors may include a C-clip that contacts the L-shaped conductive connector and at least one of the first antenna element 150, the second antenna element 170, the ground 133, and the wireless transmission/reception circuit 136. Thus, the connectors may electrically connect the conductive border 110 to at least one of the first antenna element 150, the second antenna element 170, the ground 133, and the wireless transmission/reception circuit 136. However, aspects are not limited as such.

Further, the first antenna element 150 and the second antenna element 170 may be formed on an inner bracket or inner housing. For example, the first antenna element 150 and the second antenna element 170 may be formed on a plastic inner housing coated with gold or other conductive materials. The antenna elements 150 and 170 may be connected to a conductive connector, such as a C-Clip, an L-Clip, a connection wire, etc. Further, the antenna elements 150 and 170 may extend from a surface to the opposite surface through e.g., a via hole and the like.

Figure 16A:
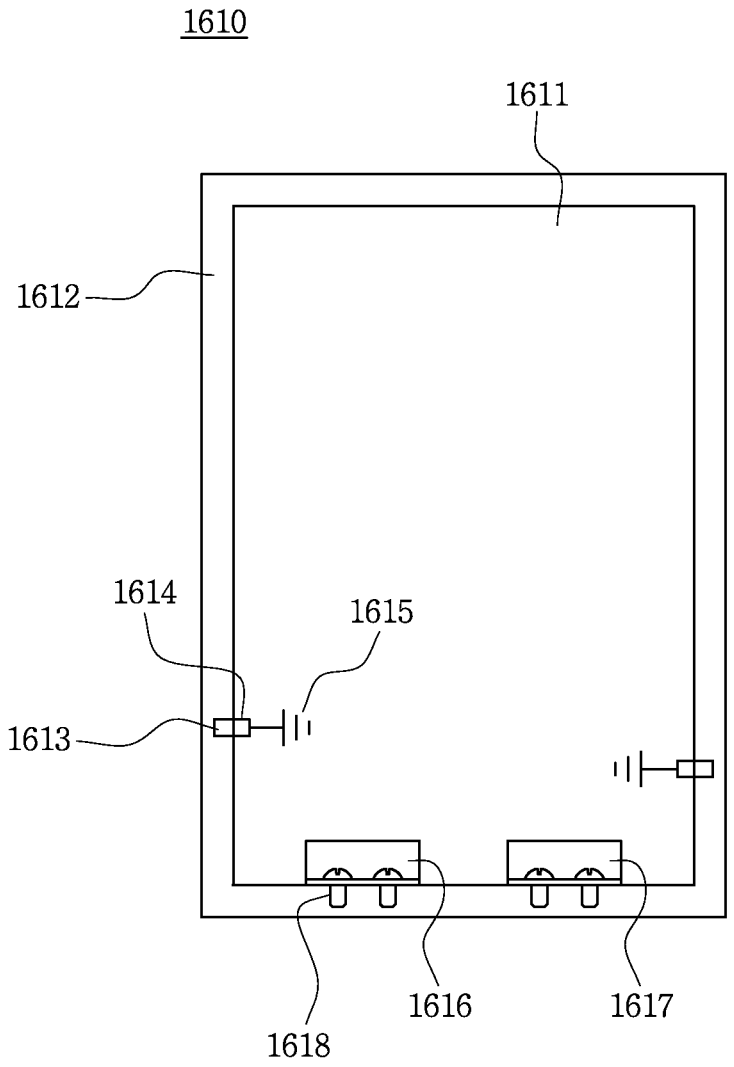
FIG. 16A is a view illustrating a mobile terminal housing surrounded by a loop-shape conductive border according to an exemplary embodiment of the present invention.

FIG. 16A is a view illustrating a mobile terminal housing surrounded by a loop-shape conductive border according to an exemplary embodiment of the present invention.

Figure 16B:
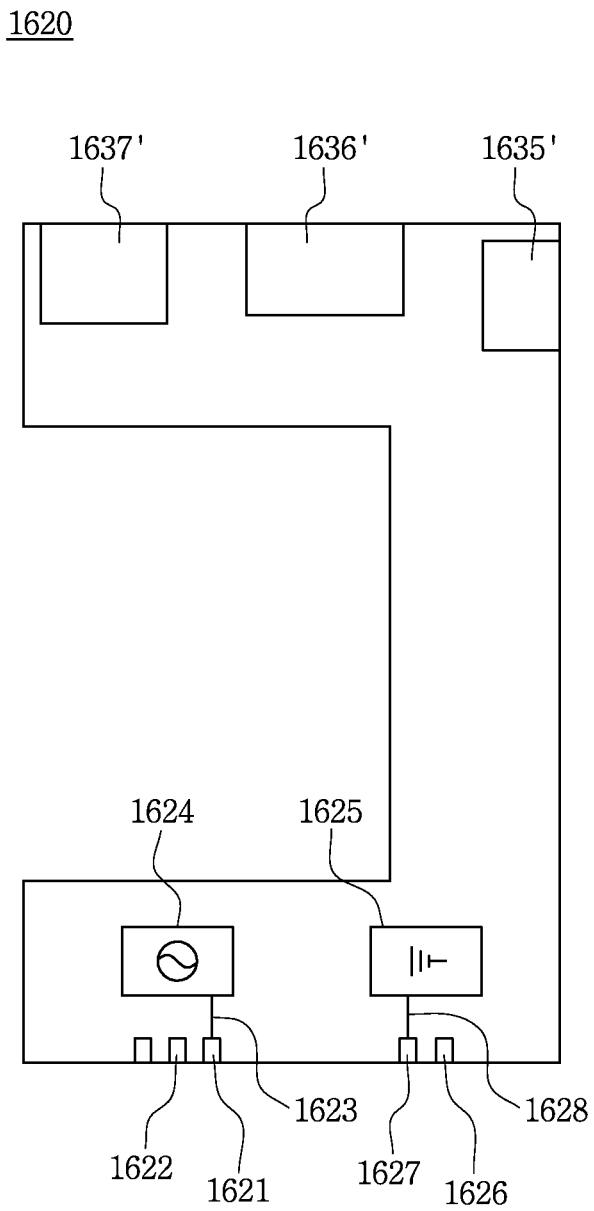
FIG. 16B is a view illustrating a substrate configured to be disposed on the mobile terminal housing of FIG. 16A according to an exemplary embodiment of the present invention.

FIG. 16B is a view illustrating a substrate configured to be disposed on the mobile terminal housing of FIG. 16A according to an exemplary embodiment of the present invention.

Figure 16C:
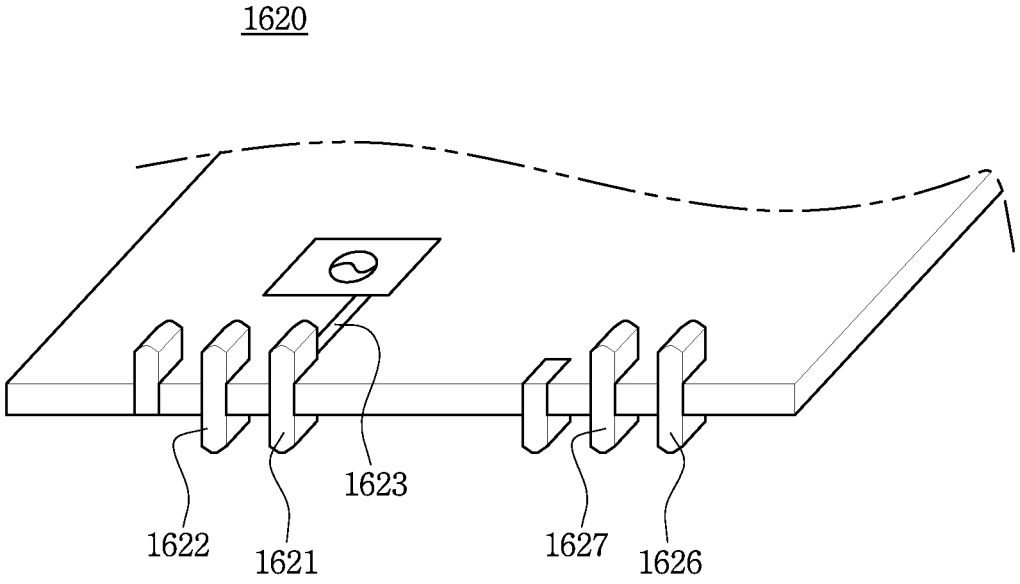
FIG. 16C is a partial perspective view illustrating a substrate configured to be disposed on the mobile terminal housing of FIG. 16A according to an exemplary embodiment of the present invention.

FIG. 16C is a partial perspective view illustrating a substrate configured to be disposed on the mobile terminal housing of FIG. 16A according to an exemplary embodiment of the present invention.

Figure 16D:
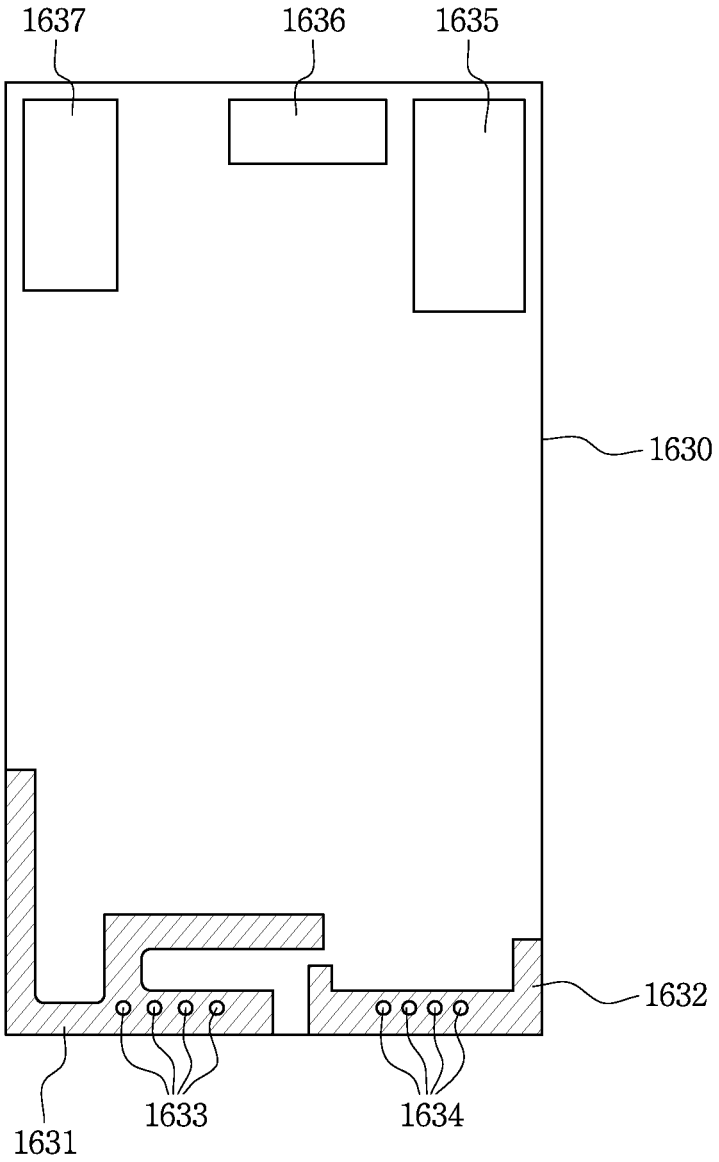
FIG. 16D is a top plan view illustrating an inner housing configured to be disposed on the substrate of FIG. 16B according to an exemplary embodiment of the present invention.

FIG. 16D is a top plan view illustrating an inner housing configured to be disposed on the substrate of FIG. 16B according to an exemplary embodiment of the present invention.

Figure 16E:
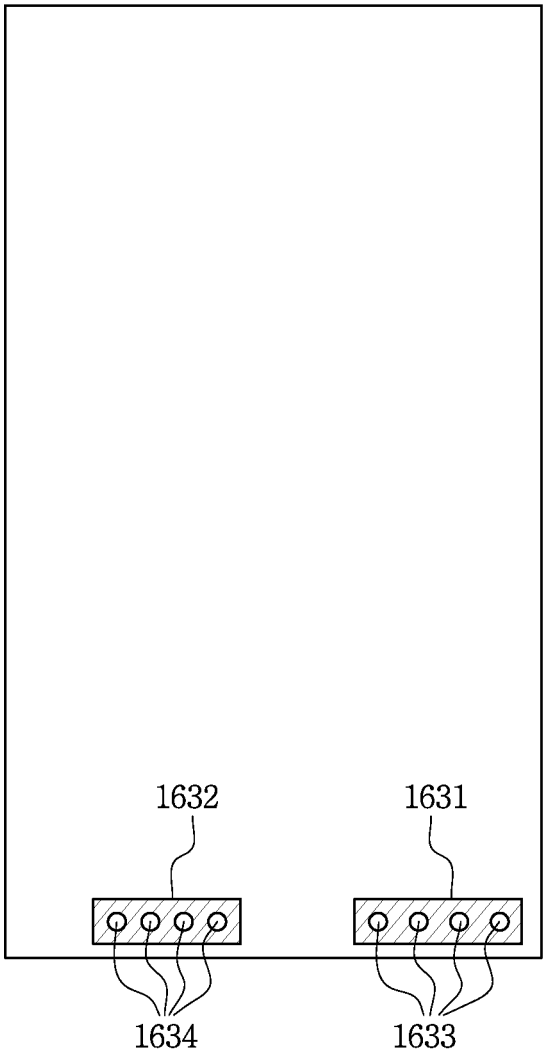
FIG. 16E is a bottom plan view illustrating an inner housing configured to be disposed on the substrate of FIG. 16B according to an exemplary embodiment of the present invention.

FIG. 16E is a bottom plan view illustrating an inner housing configured to be disposed on the substrate of FIG. 16B according to an exemplary embodiment of the present invention.

Referring to FIG. 16A to FIG. 16E, the mobile terminal part 1610 includes a housing 1611 including a conductive border 1612 that surrounds at least portion of each side surface of the housing 1611. More specifically, the conductive border 1612 may form entire or partial side surfaces of the housing 1611. A first location 1613 of the conductive border 1612 may be electrically connected to a ground 1615 via a conductive connector 1614. The conductive connector 1614 may be a C-clip, an L-clip, a conductive screw, and the like. The ground 1615 may be formed or disposed on the housing 1611 or a substrate 1620 illustrated in FIG. 16B. The substrate 1620 may be a printed circuit board, a flexible printed circuit board, and the like on which various circuits and chips are disposed. The housing 1611 may include an L-shaped conductive connector 1616 and/or 1617 that connects a portion of the conductive border 1612 to one or more connectors, e.g., conductive C-clip connectors 1621 and 1622. Conductive screws 1618 may connect the L-shaped conductive connector 1616 and the conductive border 1612. The substrate 1620 may be disposed on the housing 1611 such that the conductive C-clip connectors 1621 and 1622 contact the L-shaped conductive connector 1616. At least one of the conductive C-clip connectors 1621 and 1622 may contact a portion of a first antenna element 1631 illustrated in FIG. 16E such that the first antenna element 1631 may be electrically connected to the conductive border 1612 and/or the wireless transmission/reception circuit 1624. According to other aspects, the conductive border 1612 may have an L-shaped portion and directly contact C-clip connectors 1621 and 1622 without having the intervening connectors, such as the L-shaped conductive connector 1616 and the conductive screws 1618. Similarly, a portion of the conductive border 1612 may be electrically connected to a ground element 1625 and/or a portion of a second antenna element 1632 illustrated in FIG. 16E.

As shown in FIG. 16B, the substrate 1620 may include a wireless transmission/reception circuit 1624, a ground element 1625, and other circuits. The wireless transmission/reception circuit 1624 and the ground element 1625 may be wireless transmission/reception circuit 136 and the ground element 133 described above, respectively. However, aspects are not limited as such. Further, the substrate 1620 may include conductive connectors 1621, 1622, 1623, 1626, 1627, and 1628 that electrically connects at least two of certain elements, e.g., ground elements 1615 or 1625, a first antenna element 1631, a second antenna element 1632, portions of the conductive border 1612, the wireless transmission/reception circuit 1624, etc. For example, the conductive connectors 1621, 1622, and 1623 may electrically connect at least two of the wireless transmission/reception circuit 1624, the first antenna element 1631, the conductive border 1612 through a trace 1623 on the substrate 1620, via holes on the inner housing 1633, and the like. The conductive connectors 1621 and 1622 may be disposed at different locations and the distance between the conductive connectors 1621 and 1622 may be determined according to different wireless communication frequency band characteristics. By determining the numbers and locations of the connectors 1621 and 1622, the frequency band characteristics may be changed. Similarly, conductive connectors, such as the connectors 1626, 1627, and 1628, may electrically connect at least two of the conductive border 1612, the second antenna element 1632, and the ground element 1625.

Referring to FIG. 16D, an inner housing 1630 may be disposed on the substrate 1620 to cover at least portion of the substrate 1620 and electrically connect antenna elements 1631 and 1632 to connectors, e.g., the connectors 1621, 1622, 1626, and 1627, formed on the substrate 1620. The antenna elements 1631 and 1632 may be formed on at least one of the front and rear surfaces of the inner housing 1630 by coating conductive materials thereon. Via holes 1633 and 1634 may be formed on the inner housing 1630 such that the antenna elements 1631 and 1632 formed on the front surface of the inner housing 1630 electrically extend to the rear surface of the inner housing 1630 through the via holes 1633 and 1634. The antenna elements 1631 and 1632 may be connected to connectors, such as connectors 1621 and 1622 and connectors 1626 and 1627, respectively, when the inner housing 1630 is disposed on the substrate 1620, for example.

As shown in FIG. 16B and FIG. 16D, antennas for relatively narrower bands may be disposed on a portion of the inner housing opposite to the antenna elements 1631 and 1632. For example, GPS, Wi-Fi and other narrower band antennas, e.g., antenna elements 1635, 1636, and 1637, may be formed relatively close to each other if the frequency bands for the antenna elements 1635, 1636, and 1637 are not significantly overlapping. Each of the antenna elements 1635, 1636, and 1637 may be connected to different portions of the conductive border 1612 and use the respective portion of the conductive border 1612 as a partial antenna element. Each respective portion of the conductive border 1612 may be distinguished by a conductive connector connected to a ground element. Connectors and antenna circuits for the antenna elements 1635, 1636, and 1637 may be disposed on the respective portions 1635', 1636', and 1637' of the substrate 1620. The configurations may be similar to the configuration of FIG. 10, and thus more detailed description will be omitted.

As shown in FIG. 16C, one or more connectors may directly contact at least one of the antenna elements 1631 and 1632, the wireless transmission/reception circuit 1624, the ground element 1625, and the conductive border 1612, while other connectors do not directly contact at least one of the antenna elements 1631 and 1632, the wireless transmission/reception circuit 1624, the ground element 1625, and the conductive border 1612. For example, an upper protrusion of a C-clip connector 1622 may contact the first antenna element 1631. A trace 1623 may connect the C-Clip connector 1621 and the wireless transmission/reception circuit 1624. A bottom protrusion of the C-clip connector 1621 may contact a portion of the conductive border 1612 directly or through the L-shaped conductive connector 1616. Another C-clip connector may not include an upper protrusion, a bottom protrusion or a trace connected thereto, so at least one of the conductive border 1612, the first antenna element 1631, and the wireless transmission/reception circuit 1624 may not be directly connected to the other C-clip connector. Similarly, connectors disposed on the substrate, e.g., connectors 1627 and 1628, may have or may not have bottom portions, upper portions, and/or traces connected thereto based on frequency band configurations. However, some C-clip connectors that do not directly contact the antenna elements 1631 and 1632, the wireless transmission/reception circuit 1624, or the ground element 1625 may be electrically connected thereto via other conductive elements that contact the C-clip connectors. The configurations may be determined according to various requirements including frequency band characteristic requirements for multi-bands, such as Wideband Code Division Multiple Access (WCDMA), Long Term Evolution (LTE) and other mobile communication frequency bands, Wi-Fi, Bluetooth®, GPS frequency bands, and the like. By changing the numbers of the connectors, distances between the connectors, the protrusion shapes of the connectors, the multi-band antenna characteristics may be varied.

It will be apparent to those skilled in the art that various modifications and amount of change can be made in the present invention without departing from the spirit or scope of the invention. Thus, it is intended that the present invention cover the modifications and amount of changes of this invention provided they come within the scope of the appended claims and their equivalents.

What is claimed is:

1. A mobile terminal, comprising:

a wireless transmission/reception circuit to output a signal for a wireless communication of the mobile terminal;

a continuous[1] conductive border that surrounds side surfaces of the mobile terminal;

a ground element electrically connected to the conductive border at a discrete location through a first connection wire;

a first antenna radiating length comprising a first portion of the conductive border and a first antenna element electrically connected to the conductive border through a first contact and a first connector and the wireless transmission/reception circuit through a second connector[2], the first antenna radiating length configured to form a first resonance by a first path extending from one end of the first antenna through the first contact and first connector to the conductive border and along the conductive border in a first direction to the first connection wire, and a second resonance by a second path extending from the one end of the first antenna through the first contact and the first connector to the conductive border and along the conductive border in a second direction opposite to the first direction:

and a second antenna radiating length comprising a second portion of the conductive border and a second antenna element electrically connected to the conductive border and the ground element, the second antenna configured as a second continuous conductive form.

2. The mobile terminal of claim 1, wherein the conductive border has a continuous loop shape along sides of the mobile terminal, the sides corresponding to a periphery of a front surface of the mobile terminal, the front surface comprising a display screen.

3. The mobile terminal of claim 1, wherein the conductive border comprises a first conductive portion and a second conductive portion, the first conductive portion and the second conductive portion being connected to the first antenna element.

4. The mobile terminal of claim 3, wherein at least one of the first conductive portion and the second conductive portion is connected to the wireless transmission/reception circuit.

5. The mobile terminal of claim 3, wherein the first conductive portion and the first antenna element provide a first radio frequency band, and the second conductive portion and the first antenna element provide a second radio frequency band.

6. The mobile terminal of claim 3, wherein the first conductive portion and the second conductive portion are electrically connected to the ground element by a connector.

7. The mobile terminal of claim 3, further comprising:

a third antenna comprising the first conductive portion, the third antenna being a loop antenna.

8. The mobile terminal of claim 7, further comprising:

a fourth antenna connected to a third conductive portion of the conductive border.

9. The mobile terminal of claim 1, wherein three or more portions of the conductive border are electrically connected to the ground element.

10. The mobile terminal of claim 1, wherein the first antenna element or the second antenna element is electrically connected to two or more portions of the conductive border by connectors.

11. The mobile terminal of claim 1, wherein the wireless transmission/reception circuit and the ground element are mounted on a printed circuit board arranged in the mobile terminal.

12. The mobile terminal of claim 1, wherein the conductive border is made of conductive metal, and at least a portion of the conductive border that connects the first antenna element and the second antenna element is continuous.

13. The mobile terminal of claim 1, wherein the first antenna element is relatively longer than the second antenna element.

14. A mobile terminal, comprising:

a wireless transmission/reception circuit to output a signal for a wireless communication of the mobile terminal;

a continuous conductive border that surrounds side surfaces of the mobile terminal; a ground element electrically connected to the conductive border at a first location through a first connection wire, and capacitively coupled to the conductive border at a second location;

a first antenna radiating length comprising a first portion of the conductive border and a first antenna element electrically connected to at least one of the conductive border through a first connector and the wireless transmission/reception circuit through a second connector, the first antenna radiating length configured to form a first resonance by a first path extending from one end of the first antenna through the first connector to the conductive border and along the conductive border in a first direction to the first connection wire, and a second resonance by a second path extending from the one end of the first antenna through the first connector to the conductive border and along the conductive border in a second direction opposite to the first direction to the second location;

and a second antenna radiating length comprising a second portion of the conductive boarder and a second antenna element electrically connected to the conductive border and the ground element, the second antenna configured as a second continuous conductive form.

15. The mobile terminal of claim 14, wherein the conductive border has a continuous loop shape along sides of the mobile terminal, the sides corresponding to a periphery of a front surface of the mobile terminal, the front surface comprising a display screen.

16. The mobile terminal of claim 14, further comprising a third antenna element comprising the second connector, a portion of the conductive border, and the first connection wire.

* * * * *